United States Patent [19]

Durand et al.

[11] Patent Number: 4,480,491

[45] Date of Patent: Nov. 6, 1984

[54] FORCE LIMITING GEAR REDUCER FOR LIFTING PINION OF SELF-ELEVATING PLATFORM

[75] Inventors: François Durand, Antibes, France; Auguste Smulders, Geneva, Switzerland

[73] Assignee: Societe Anonyme Engrenages et Reducteurs, Velizy Villacoublay, France; a part interest

[21] Appl. No.: 250,145

[22] Filed: Apr. 2, 1981

[30] Foreign Application Priority Data

Nov. 10, 1980 [FR] France ..... 80 24386

[51] Int. Cl.[3] ..... F16H 57/00; F16H 57/10; F16H 1/04; E02B 17/08

[52] U.S. Cl. ..... 74/411; 405/198; 74/411.5; 74/422; 74/421 A

[58] Field of Search ..... 74/411.5, 422, 411, 74/421 A; 405/198, 196, 197, 199, 200; 254/95, 105, 96, 97

[56] References Cited

U.S. PATENT DOCUMENTS

| | | | |
|---|---|---|---|
| 1,923,879 | 8/1933 | Parsons | 74/421 A |
| 3,014,346 | 12/1961 | Small | 405/198 |
| 3,056,573 | 10/1956 | Matheson et al. | 74/422 |
| 3,174,353 | 3/1965 | Gross | 74/421 A |
| 3,738,031 | 6/1973 | Lott | 74/411 |
| 3,986,368 | 10/1976 | Levingston | 405/196 |

*Primary Examiner*—Lawrence J. Staab
*Assistant Examiner*—Michael D. Bednarek
*Attorney, Agent, or Firm*—Young & Thompson

[57] ABSTRACT

A force limiting gear reducer for a lifting pinion of self-elevating platform, comprising a gear reducer divided in two parts, a first of said parts being directly connected to a pinion shaft and pinion support and a second said part comprising a shaft-mounted prime reducer with brake and motor connected to an input shaft of the first reducer, a reaction arm of the shaft-mounted prime reducer being connected to a fixed point of a jacking mechanism by means of at least one hydraulic cylinder, means to control the oil pressure in the hydraulic cylinder, and abutments limiting the stroke of the hydraulic cylinder.

5 Claims, 4 Drawing Figures

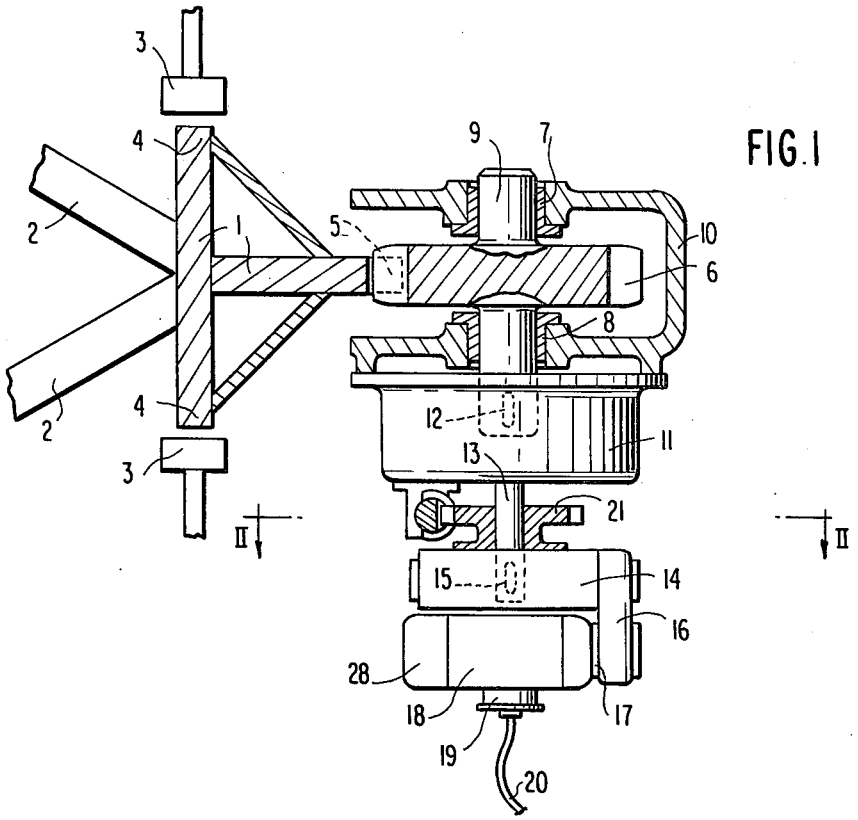
FIG. 1
FIG. 2
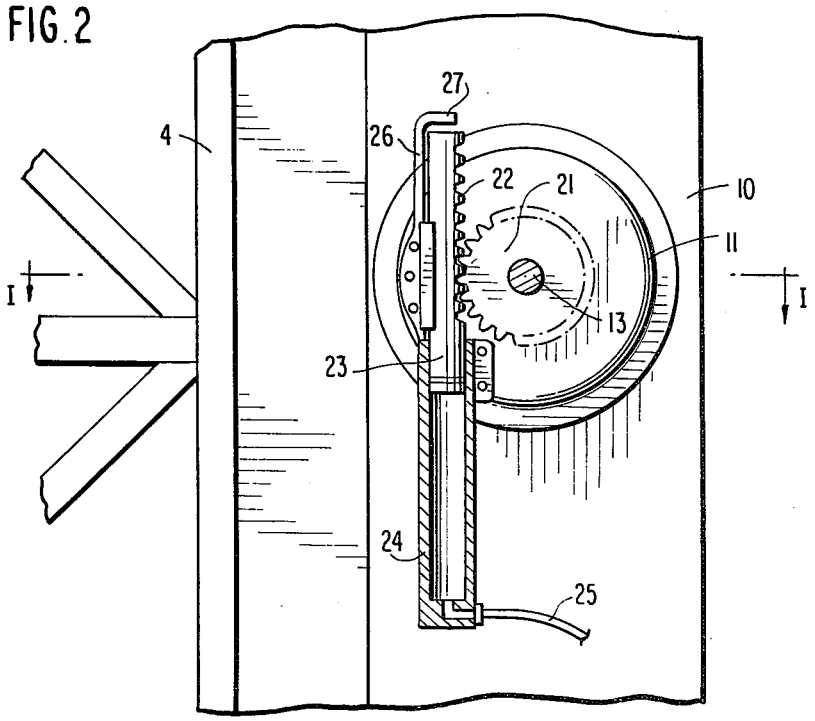

FORCE LIMITING GEAR REDUCER FOR LIFTING PINION OF SELF-ELEVATING PLATFORM

For the legs of self-elevating platforms having several leg corners each provided with racks and blocks of pinions with reducers, motors and fail-safe brakes, it is known that the pinions of a block of pinions can be subjected to severe overloads when, under the influence of wind, waves or currents, the leg shifts position with respect to the platform, within the limit of the play existing between the leg and its guides.

In practice, the value of this play is such that to take up the reversing couple of the leg relative to the platform by means of the guides and not the pinions, the brakes of the motors should slip for several turns. These brakes are always over designed and to make them slip, it is necessary to overload the pinions and the reducer parts.

It is of questionable reliability to limit the force while relying on the slipping of a brake; to avoid damage, it is necessary to provide a wide margin of safety with respect to the theoretical value, which results in expensive over design. Even if the pinions have been calculated to carry a weight greater than the reversing couple, an equal distribution of forces on the different pinions after the failure of the brakes is not ensured and substantial overloads of one pinion or another of the same row of pinions can occur.

The object of the present invention is a force limiting gear reducer for lifting a pinion of a self-elevating platform which permits, for the value of the rotation to be obtained for the pinion during a change of position of the leg between its guides, to limit in a reliable way to a precise value the forces transmitted by the pinion and the different parts of the reducer, while permitting equal distribution of the weight between the different pinions of the same corner of the leg or of the same leg.

The reducer, according to the invention, permits measuring the force acting on each pinion, which force can be a portion of the weight of the platform plus a portion of the vertical force due to the reversing couple, whilst this couple is partially vertically borne by the pinions and partially horizontally by the guides of the legs.

To this end, the reducer assembly is divided in two, a motor reducer with brake mounted floatingly on the input shaft of a second reducer which is the basic reducer which drives the pinion.

The motor reducer with brake is provided with a reaction arm which is connected to the structure by a hydraulic jack whose oil pressure is controlled; up to a certain load on the pinion, the piston of the jack will not move, beyond a predetermined load the piston will retract and the pinion will turn several degrees without uncontrolled overload until it is easy to maintain a limiting value for the pressure in a hydraulic jack. Each rotation of the pinion with the maximum controlled load corresponds to a rotation of the housing of the primary reducer with a brake and motor which is floatingly mounted, the brake can be over designed, there is no need for it to slide to permit the pinion to turn through those several degrees. If the ratio of the basic reducer connected directly to the pinion is relatively small, the rotation of the primary reducer, corresponding to the rotation of the pinion during a change of force on the leg guides, is sufficiently small to secure directly the reaction arm of the primary reducer to the structure of the raising mechanism via a sufficiently long hydraulic jack.

If the ratio of the basic reducer is great the motor reducer with brake has as its reaction arm a toothed wheel which engages with a rack which slides while bearing at the same time against a suitable guide of the casing of the basic reducer and against a hydraulic jack. The platform is suspended from the racks of the legs by means of the pinions; when the leg changes in position between its guides, the weight of the platform still rests on the pinions and to this weight will be added a reversing moment which overloads the pinion teeth which engage with the rack or racks which have the tendency to rise because of the said reversing moment. If the pinions, whose racks have a tendency to rise, permit these racks to rise while undergoing under a predetermined load the slight rotation which permits the racks to take up the position corresponding to the desired support of the leg between its guides, the pinions, their control reducers as well as the teeth of the racks will not have to support a greater load than that which corresponds to the predetermined load for the said slight rotation of the pinion.

With the force limiting reducer according to the invention, the load for which the slight rotation of the pinion can take place is not a function of the brake motor but is a function of the oil pressure in the jack against which the floating motor reducer is supported, via the rack which engages with the toothed wheel which serves as the reaction arm.

The stroke of the jack and the corresponding length of the rack are sufficiently great to permit a displacement corresponding to the slight rotation of the pinion multiplied by the reduction ratio of the basic reducer, which reduction ratio permits substantially reducing by the same proportion the retaining force of the jack relative to the force acting between the pinion and the rack of the leg. In principle, the rotation of the pinion is of the order of 15 mm at the level of the root diameter for a displacement of the leg of 25 mm at the level of the guides, with a reduction ratio of 1/80 for the basic reducer and a root diameter of the toothed wheel reaction arm equal to half the root diameter of the pinion, the jack should be adjusted for a force corresponding to 1/40 of the force on the teeth of the pinion, the stroke of the jack is thus $40 \times 15$ or 60 cm, which is quite possible.

In the present state of the art, it is very easy to regulate in a precise manner an internal pressure of a jack over all its stroke, among other things it suffices to connect it to an oleopneumatic accumulator which is suitably dimensioned. Ordinarily, the hydraulic jacks of all the pinions of the same corner of the leg are hydraulically interconnected; it is the hydraulic source of each leg corner which permits apportioning the reversing moment between leg guides and pinions. If the reversing moment is borne solely by the leg guides, then all the jacks of the same leg are hydraulically interconnected.

To restore the jack to the initial position, which is to say the path available for a slight rotation of the pinion in the descending direction of the platform, it suffices to actuate the motor and brake in the rising direction and to feed the jack while maintaining a pressure greater than that which corresponds to the action due to the couple of the motor. This operation of returning to the point of departure may be performed individually for each pinion one after the other, especially when the motor couples are not provided to effectuate raising operations at the time of severe storms.

If the combination of basic reducer, primary reducer and hydraulic jack should make it possible to effect substantial rotations of the pinion, for example for the precise positioning of the platform relative to the leg during utilization of the known system of the locking between leg and platform, a single stroke of the hydraulic jack will not suffice and several alternatives will have to be pursued; to this end, an additional brake or lock is provided between the input shaft and the housing of the basic reducer, which permits returning the hydraulic jack to its starting position while opening the motor brake without actuating the motor, the weight of the platform is then suspended during the return stroke of the jack, not by the magnetic field of the motor, but by said additional brake or lock, the brake may be a disc brake, a jaw brake or a band brake, the lock is a finger which enters a notch or a hole.

The accompanying drawings show by way of non-limitative example a force limiting gear reducer for lifting a pinion of a self-elevating platform according to the invention.

FIG. 1 is a top partial sectional view along the line I—I of FIG. 2.

FIG. 2 is a side cross-sectional view taken on the line II—II of FIG. 1.

Figure 3:
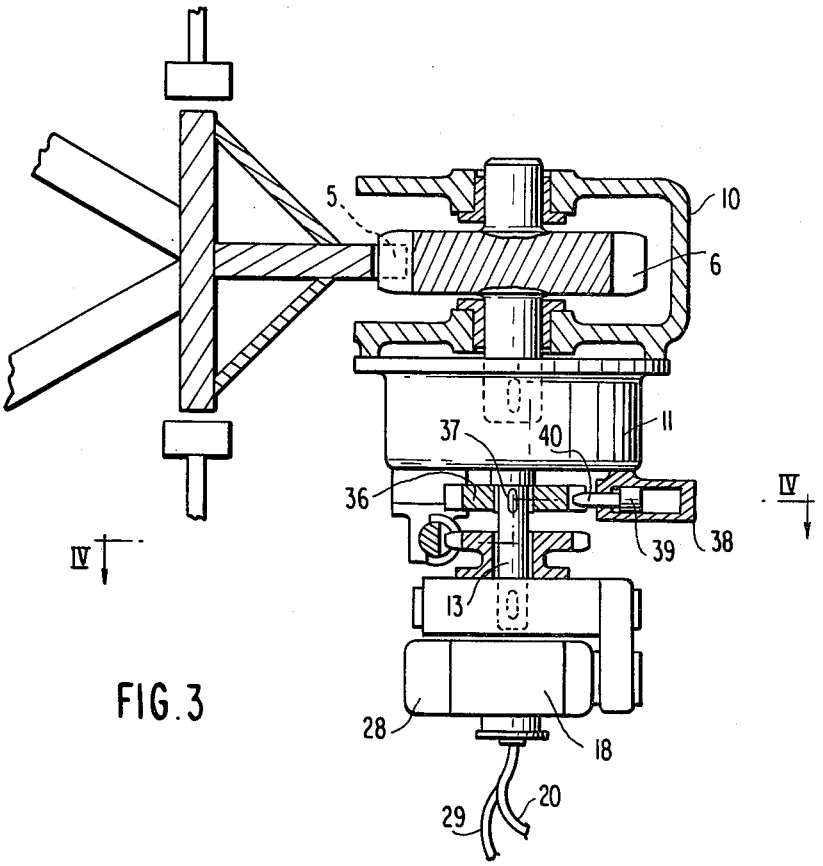
FIG. 3 is a top sectional view on the plane III—III of FIG. 4.
Figure 4:
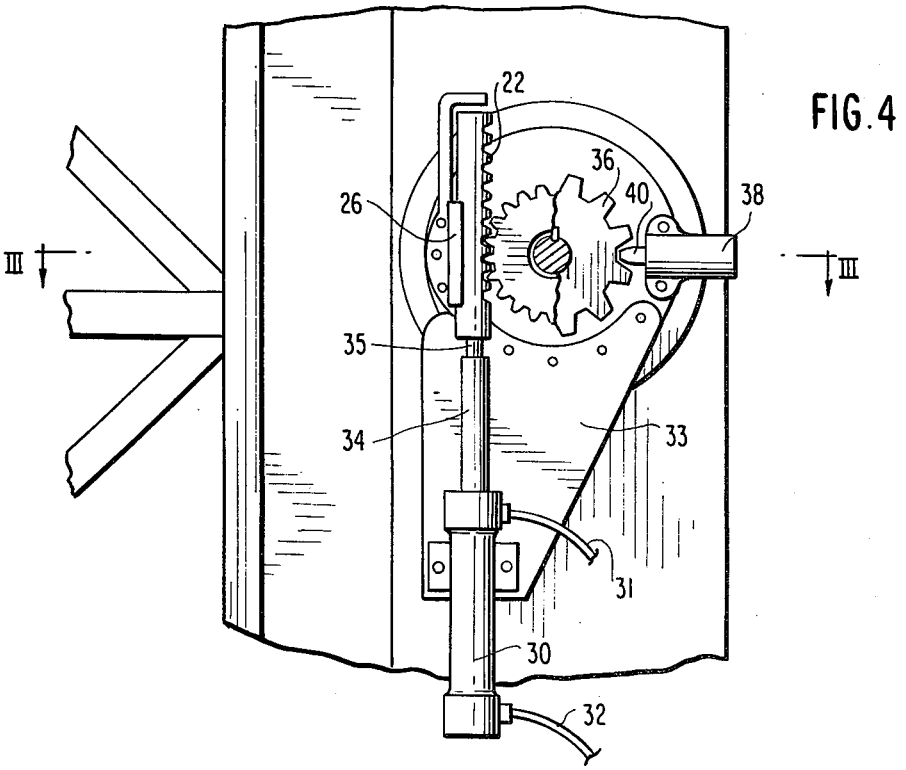
FIG. 4 is a side view along the line IV—IV of FIG. 3.

The difference between FIGS. 1 and 3 and also between FIGS. 2 and 4 is the additional locking device between the input shaft of the basic reducer and its housing, to avoid having to actuate the motor during multi-stroke operations with the hydraulic jack.

In these figures, the basic reducer as well as the floating motor reducer with a brake are not shown in section, for purposes of simplification.

In FIGS. 1 and 2, the selected reducers are a planetary reducer with a hollow shaft for the basic reducer and screw reducer with hollow shaft with a primary of two cylindrical trains for the floating motor reducer. 1 is the leg corner, 2 are the crosspiece tubes which interconnect the different corners of the leg, 3 are the pairs of guides situated at the upper part and at the lower part of the platform, guides against which the edges 4 of the leg corner 1 bear; there are generally about 50 ft. between the upper and lower guides, which makes it difficult to have more than 25 mm of play between the edges 4 and each pair of guides 3. It is the taking up of this play between the edges of corner 4 and guides 3 which is at the beginning of the small vertical displacements of the rack 5, displacement which may be effected with very great force when the modification of the position of the leg between its pairs of guides 3 is due to a storm.

6 is the pinion which engages with the rack 5; 7 and 8 are the bearings of the shaft 9 which is secured to pinion 6. 10 is the support in which the shaft 9 of pinion 6 turns; in the same support there are generally several pinions with their own reducers and motors situated one above the other; in a simplified form, a single pinion 6 is shown; according to the type of platform, this support 10 may be either rigidly fixed to the pontoon, or connected by pivotal joints or elastic members to the pontoon or to the supports for the upper guides. 11 is the basic reducer which is bolted to the support 10, the shaft 9 extends into this reducer 11 and is driven by the key 12. 16 is a primary reducer with two trains of cylindrical gearing which is driven at 17 by braked motor 18 of which 19 is the connection box and 20 the power lines, lines which are located substantially on the axis of rotation of shaft 13. 21 is a crown gear which is concentric with the shaft 13 while being secured to the casing of the reducer 14, the crown gear 21 is the reaction arm of reducer 14; 22 is a rack which is secured to piston 23 of jack 24 of which 25 is the supply tube for oil under pressure. 26 is a guide with an end of stroke abutment 27 for rack 22. Jack 24 and guide 26 are secured to the casing of the basic reducer 11.

It is easy to see that the rack 5 causing the piston 6 to turn several degrees clockwise with great force and this rotation turning the toothed wheel 21 counterclockwise, the piston 23 will retract in the jack 24 thus limiting the force between pinion 6 and rack 5 as well as between the various portions of the reducers 11 and 14 to the forces resulting from the retraction force of the piston 23 in jack 24, a force which is very easy to control by means of the oil pressure in the tube 25. When the legs are raised, the pinions support only the weights of the legs, this weight being only a small fraction of the weight of the platform; on the other hand, the bending moments on the legs, during towing ordinarily do not affect the pinions, the play between the guides and the legs being thus eliminated in the blocking wedges or stops; as a result, the limitation of force at the level of the pinions and their reducers is generally important only in the direction of the forces corresponding to holding the weight of the platform when it is raised above the water.

It is for this reason that FIGS. 1 and 2 show a single acting jack; it is evident that without departing from the nature of the invention, the end of the stroke abutment 27 may be replaced by another jack identical to 24. Thus the same anti-overload advantages may be enjoyed during towing with raised legs.

In FIG. 4, the double acting hydraulic jack 30 with supply conduits 31 and 32 is secured to the plate 33 which in turn is secured to the casing of the basic reducer 11. The piston rod 34 is secured at 35 to the rack 22 guided at 26. In FIG. 3, the notched wheel 36 is secured to the input shaft 13 of the basic reducer 11, by key 37; the double-acting hydraulic or pneumatic jack 38 is screw connected to the casing of basic reducer 11, the finger 40 secured to the piston 39 may be inserted in or withdrawn from any notch of the notched wheel 36.

It is easy to see that the platform being suspended from one rack 5 by the pinion 6, it is possible to insert the finger 40 in a notch of wheel 36, only for the time necessary for the return of the piston whose rod is 34, a time during which the brake 28 is actuated via wires 29 and thus is open, the motor 18 with its wires 20 is not actuated.

As soon as the piston whose rod is 24 is returned to its start position, the brake 28 is no longer actuated and is closed, the finger 40 is withdrawn from the notch of wheels 36 and piston 34 as well as rack 22 are ready to be displaced in the direction which permits limiting the force on the pinion 6 or to be deliberately moved in the desired direction either to impose vertically on the pinions a portion of the reversing moment of the leg in the pontoon, or to effect slow and precise movement of the pontoon relative to the leg, or at the limit for utilizing the hydraulic jacks of the pinions as a safety system for very slow descent or raising under low power, in case of electric power failure, a low power standby system suffices to actuate the hydraulic jacks of the pinions.

What we claim is:

1. A force limiting gear reducer for a lifting pinion of a self-elevating platform, comprising a gear reducer divided in two parts, a first of said parts being directly connected to a pinion shaft and pinion support and a second said part comprising a shaft-mounted prime reducer with brake and motor connected to an input shaft of the first reducer, a reaction arm of the shaft-mounted prime reducer being connected to a fixed point of a jacking mechanism by means of at least one hydraulic cylinder, means to control the oil pressure in the hydraulic cylinder, and abutments limiting the stroke of the hydraulic cylinder.

2. A force limiting gear reducer for a lifting pinion of a self-elevating platform, comprising a gear reducer divided in two parts, a first of said parts being directly connected to a pinion shaft and pinion support and a second of said parts comprising a shaft-mounted prime reducer with brake and motor connected to an input shaft of the first reducer, a reaction arm on the shaft-mounted prime reducer in the form of a geared wheel meshing with a guided rack which is axially connected to at least one hydraulic cylinder, means to control the oil pressure in the hydraulic cylinder, and abutments limiting the stroke of the guided rack.

3. A force limiting gear reducer for a lifting pinion of a self-elevating platform, comprising a gear reducer divided in two parts, a first of said parts being directly connected to a pinion shaft and pinion support and a second gear reducer in the form of a shaft-mounted prime reducer with brake and motor connected to an input shaft of the first reducer, a reaction arm of the shaft-mounted prime reducer in the form of a geared wheel meshing with a guided rack which is axially connected to at least one double-acting hydraulic cylinder, means to control oil pressure in the hydraulic cylinder, and abutments limiting the stroke of the guided rack.

4. A gear reducer as claimed in claim 1, and a slotted wheel fixed on said input shaft of said first gear reducer, and a double-acting cylinder fixed to the housing of the first reducer, said double-acting cylinder having a piston selectively engageable in a slot of said slotted wheel thereby to provide a clamping device between said input shaft and said housing of the first reducer.

5. A gear reducer as claimed in claim 1, and brake means between said input shaft and a housing of said first gear reducer.

* * * * *